US007598923B2

(12) United States Patent
Hardacker et al.

(10) Patent No.: US 7,598,923 B2
(45) Date of Patent: Oct. 6, 2009

(54) APPARATUS AND METHOD FOR COMMUNICATIONS VIA MULTIPLE MILLIMETER WAVE SIGNALS

(75) Inventors: Robert Hardacker, Escondido, CA (US); Robert Unger, El Cajon, CA (US)

(73) Assignees: Sony Corporation, Tokyo (JP); Sony Electronics Inc., Park Ridge, NJ (US)

( * ) Notice: Subject to any disclaimer, the term of this patent is extended or adjusted under 35 U.S.C. 154(b) by 517 days.

(21) Appl. No.: 11/419,609

(22) Filed: May 22, 2006

(65) Prior Publication Data

US 2007/0270017 A1 Nov. 22, 2007

(51) Int. Cl.
*H01Q 1/50* (2006.01)
*H01Q 1/42* (2006.01)
*H01Q 21/00* (2006.01)

(52) U.S. Cl. ..... 343/906; 343/872; 343/893

(58) Field of Classification Search ..... 343/872, 343/893, 906
See application file for complete search history.

(56) References Cited

U.S. PATENT DOCUMENTS

| | | | | |
|---|---|---|---|---|
| 5,073,761 | A | 12/1991 | Waterman et al. | |
| 6,556,836 | B2 | 4/2003 | Lovberg | |
| 6,806,835 | B2 * | 10/2004 | Iwai et al. | 343/702 |
| 6,975,276 | B2 | 12/2005 | Brown | |
| 2002/0164951 | A1 | 11/2002 | Slaughter | |
| 2002/0165002 | A1 | 11/2002 | Kolinko | |
| 2003/0169134 | A1 | 9/2003 | Ammar et al. | |
| 2005/0134513 | A1 | 6/2005 | Williams et al. | |

FOREIGN PATENT DOCUMENTS

| | | | |
|---|---|---|---|
| WO | 2004066610 | A2 | 8/2004 |
| WO | 2005027275 | A1 | 3/2005 |
| WO | 2006078417 | A2 | 7/2006 |

OTHER PUBLICATIONS

Int'l Searching Authority, , *International Search Report and Written Opinion of the International Searching Authority for PCTUS2007069198* mailed Oct. 2, 2008.
European Search Report from European Application No. 2020056 mailed May 06, 2009 (86688EP).
Lohinetong, D. et al., "Microstrip to Surface Mounted Foam-Based Waveguide Transition for Ka-Band Filter Integration", *Microwave and Millimeter Wave Technology, 2004. ICMMT 4th International Conference, Beijing China, Aug. 18-21, 2004. Piscataway, NJ, USA Aug. 18, 2004*, pp. 899-902 XP010797513, ISBN 978-0-7803-8401-9.

* cited by examiner

*Primary Examiner*—Shih-Chao Chen
(74) *Attorney, Agent, or Firm*—Fitch, Even, Tabin & Flannery

(57) ABSTRACT

To achieve ultra-high bandwidth data transmission according to embodiments of the invention, a plurality of parallel 60 GHz band frequency signals traveling in substantially parallel paths is employed. A connector or housing includes a plurality of metallized, grounded shells or chambers having antenna pairs that are embedded therein. There is no physical contact between the transmitter and receiver antennas. Instead, the metallized, grounded connector chambers provide isolation between adjacent radio links which all operate on the same frequency.

33 Claims, 6 Drawing Sheets

APPARATUS AND METHOD FOR COMMUNICATIONS VIA MULTIPLE MILLIMETER WAVE SIGNALS

FIELD OF INVENTION

This invention generally pertains to wireless communications systems. More particularly, this pertains to connectors and other devices for use in the transmission of millimeter wave RF signals.

BACKGROUND

Recent advances in the field of wireless communications integrated circuit design have resulted in the promise of much higher frequency and data rate broadcast capability at significantly reduced prices. Being developed are integrated circuits in which both radio and signal processing circuits for the millimeter wave spectrum of frequencies are placed on one integrated circuit chip.

Wireless transmission in the 60 GHz band (i.e., 57-65 GHz) has several advantages. First, this band is unlicensed by the Federal Communications Commission (FCC) in the United States, and moreover, the band is unlicensed in most of the rest of the world. Second, due to the extremely short wavelengths the use of this band requires a very small antenna which can be embedded in the same integrated circuit as the radio and signal processing circuitry. Moreover, very high data transmission rates can be achieved in the 60 GHz frequency range, including rates of the order of several gigabits per second ("Gbps"). This makes possible wireless transmission of very large quantities of data including, but not limited to, uncompressed, high definition television (HDTV) signals, the rapid wireless transmission of a high definition movie file to a portable device, or other useful high bandwidth applications.

The usefulness of very high wireless bandwidth is not limited to applications involving transmission distances of several meters, or more. In certain communication link applications, it is desirable that high bandwidth signals be wirelessly transmitted over relatively short distances, such as for instance, a distance of a couple of centimeters or less.

For example, high bandwidth transmission of data in a wireless mode can be advantageous where there exist many wires or data transmission paths leading to one transmitter (such as for example, 32 wires for one transmitter), to reach a high data rate of 1 Gbps channel, for example. Thus when 32 signals are sent in parallel for multiplexing into a 1 Gbps channel that is transmitted serially, a wireless transmission can provide bandwidths that are superior to that which may be achieved via wired connections between a data source and a sink. What is important in certain applications, therefore, is not the distance a wireless signal travels, but rather the bandwidth of such a wireless signal. Thus a 1 or 2 cm transmission distance (or less) would be acceptable. This also provides a degree of isolation between the transmitter and receiver.

Digital communications, entertainment, and business uses have evolved such that ever increasing bandwidth requirements continue. Although the bandwidth associated with a millimeter wave frequency signal is relatively large, it nevertheless is desirable to achieve ultra-high bandwidth capabilities of hundreds of Gbps or more, using the millimeter wave spectrum of frequencies.

SUMMARY OF THE ILLUSTRATED EMBODIMENTS

To achieve ultra-high bandwidth data transmission according to embodiments of the invention, a plurality of parallel 60 GHz band frequency signals (or other millimeter wave signals) traveling in substantially parallel paths are employed. A connector or housing includes metallized, grounded shells or chambers having antenna pairs that are embedded therein. In exterior appearance, the housing is similar to that used for traditional, power connectors for computer components which enable physical contact between the pins contained within the connector shells. In this instance there is no physical contact between the transmitter and receiver antennas. Instead the metallized, grounded connector chambers or shells provide isolation between adjacent radio links which can all operate on the same frequency. Careful selection of the physical parameters of the shell creates a waveguide to increase the efficiency of transmission while lowering the necessary power of the transmitter.

In another embodiment, a first housing comprises a first plurality of walls defining a first plurality of chambers. A first plurality of antennas is disposed within the first plurality of chambers and is adapted for communication at a frequency in the millimeter wave spectrum of frequencies. A second housing comprises a second plurality of walls defining a second plurality of chambers. A second plurality of antennas is disposed within the second plurality of chambers and is adapted for communication at the same frequency. At least a portion of at least one wall that defines each chamber of either the first plurality of chambers or the second plurality of chambers is constructed of a conductive material. The first plurality of chambers is aligned with the second plurality of chambers when the first housing is adjacent to the second housing.

In one aspect, the first and second pluralities of antennas are adapted for communication via a plurality of signals that travel in a plurality of paths that are substantially parallel.

In another aspect, a first plurality of semiconductor devices is at least partially disposed within the first plurality of chambers. The first plurality of semiconductor devices includes the first plurality of antennas disposed therein. A second plurality of semiconductor devices is at least partially disposed within the second plurality of chambers. The second plurality of semiconductor devices includes the second plurality of antennas disposed therein.

In another aspect, the first and second housings are mechanically and electrically connected to a printed circuit board with the first housing positioned adjacent to the second housing.

In yet another aspect, the first housing is mechanically and electrically connected to a first printed circuit board, and the second housing is mechanically and electrically connected to a second printed circuit board. The first and second printed circuit boards are adapted for placement adjacent to one another thereby positioning the first housing adjacent to the second housing.

In an alternative embodiment, a method of communication comprises positioning a first housing adjacent to a second housing. The first housing has a first plurality of walls defining a first plurality of chambers, and the second housing has a second plurality of walls defining a second plurality of chambers. At least a portion of at least one wall that defines each chamber of either the first or second plurality of chambers is constructed of a conductive material. The first plurality of chambers is aligned with the second plurality of chambers when the first housing is adjacent to the second housing. A plurality of wireless signals is transmitted at a frequency in the millimeter wave spectrum of frequencies using a first plurality of antennas disposed in the first plurality of chambers. The plurality of wireless signals is received using a second plurality of antennas disposed in the second plurality of chambers.

In another aspect, the plurality of wireless signals is transmitted in a plurality of paths that are substantially parallel.

There are additional aspects to the present inventions. It should therefore be understood that the preceding is merely a brief summary of some embodiments and aspects of the present inventions. Additional embodiments and aspects are referenced below. It should further be understood that numerous changes to the disclosed embodiments can be made without departing from the spirit or scope of the inventions. The preceding summary therefore is not meant to limit the scope of the inventions. Rather, the scope of the inventions is to be determined by appended claims and their equivalents.

BRIEF DESCRIPTION OF THE DRAWINGS

These and/or other aspects and advantages of the present invention will become apparent and more readily appreciated from the following description of certain embodiments, taken in conjunction with the accompanying drawings of which.

DETAILED DESCRIPTION

Figure 1A:
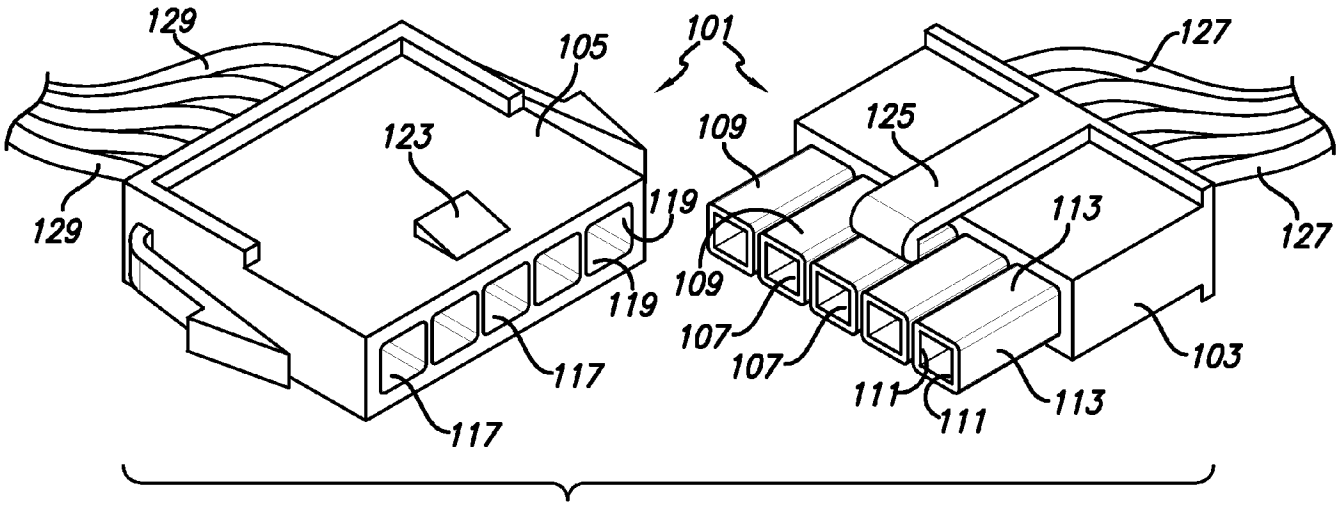
FIG. 1A is a perspective view of a connector assembly in accordance with one embodiment of the invention.

The following description is of the best mode presently contemplated for carrying out the invention. Reference will be made in detail to embodiments of the present invention, examples of which are illustrated in the accompanying drawings, wherein like reference numerals refer to like elements throughout. It is understood that other embodiments may be used and structural and operational changes may be made without departing from the scope of the present invention.

According to an embodiment of the invention, ultra-high bandwidth data transmission is achieved by transmitting a plurality of parallel 60 GHz band frequency signals (or other millimeter wave signals) in substantially parallel paths. Each signal is transmitted via a narrow beam that is achieved by configuration of one or more transmission antennas per signal. Ordinarily, a plurality of parallel, wireless signals transmitted via the same (or very closely similar) frequency has the potential for signal interference.

Embodiments of the invention overcome this problem by use of metallized, grounded shells or chambers. Transmitter and receiver antenna pairs are embedded in a metallized connector or housing. In exterior appearance, the housing is similar to that used for traditional, electrical power connectors for computer components. However there is no physical contact between the transmitter and receiver antennas. Instead the metallized, grounded connector chambers or shells provide isolation between adjacent radio links which can all operate on the same frequency.

The grounded chambers allow for a high density array of these antenna pairs enabling many Gbps of data to be communicated. An added benefit is that the connector housing provides mechanical alignment of the transmitter and receiver links. First, each individual active element or antenna is aligned within its individual chamber within the connector housing. Secondly the connector mechanically aligns one or more individual active elements to an optimal configuration which minimizes power usage and signal leakage. This creates a waveguide structure. Unlike optical or electromechanical connectors which tend to require very exacting alignments, embodiments of the invention allow for "sloppy" assembly/alignments and still deliver optimal communications performance. The user experience would be comparable to using computer component power supply connectors today, except that no physical contact occurs between the antennas; the only contact is via the connector housings themselves.

Figure 1B:
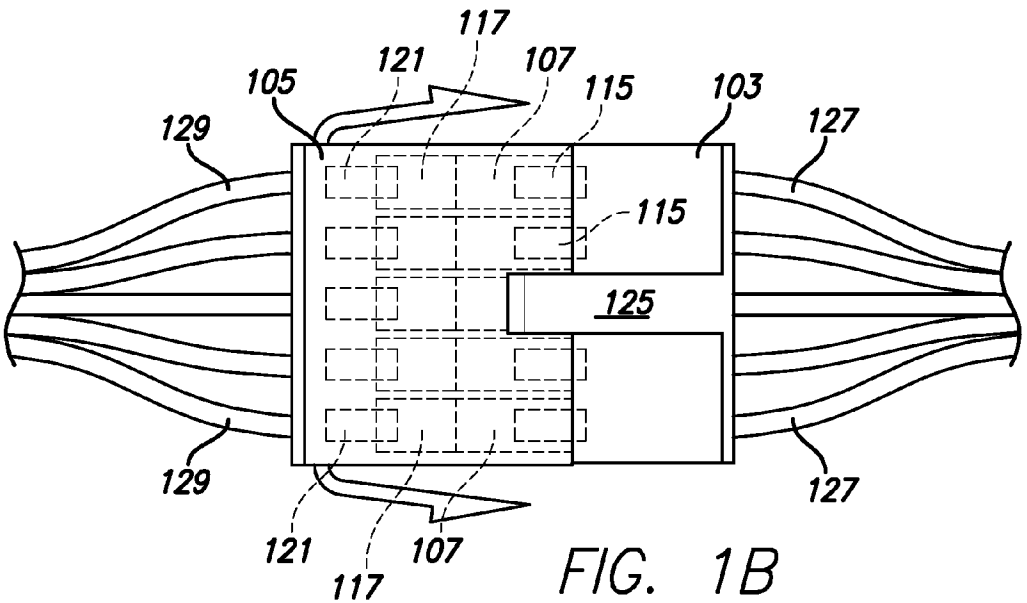
FIG. 1B is a top plan view of the connector assembly of FIG. 1A wherein the two housings are mated.

Referring now to FIGS. 1A and 1B, there is shown a connector assembly 101 for use in wireless millimeter wave communications. Shown is a first housing 103 and a second housing 105. The first housing 103 is comprised of a first plurality of chambers 107 defined by a plurality of projections 109 disposed in a one-dimensional array. Each chamber 107 has a plurality of outer walls 113 and a plurality of inner walls 111 that define the chamber 107 and that are constructed of a conductive material, such as aluminum, that is connected to ground. In alternative embodiments, however, the outer walls 113 of each chamber could be constructed of the conductive material, or the entire chamber body could be constructed of the conductive material.

A plurality of semiconductor devices 115 is embedded within the first housing 103 and is partially disposed within the first plurality of chambers 107. The plurality of semiconductor devices 115 includes a plurality of antennas (not shown) disposed in the semiconductor devices 115 in such a way that at least a portion of each of the antennas is located within the first plurality of chambers 107. Thus each chamber 107 contains at least one antenna that is configured and aligned within the chamber 107 for the transmission of a relatively narrow beam directed down the length of the chamber 107. Each of the antennas is adapted for communication at a frequency in the millimeter wave spectrum of frequencies, such as for example, the 60 GHz band. A plurality of cables 127 having one or more connectors within provide electrical connections between the semiconductor devices 115 in the first housing 103 and a circuit board (not shown) or other device.

The second housing 105 is comprised of a second plurality of chambers 117 disposed in a one-dimensional array. Each chamber 117 is defined by a plurality of interior walls 119 of the housing 105 and is adapted to receive one of the plurality of projections 109 of the first housing 103 as best seen in FIG. 1B. Each interior wall 119 is constructed of a conductive material, such as aluminum, which is electrically connected to ground. A second plurality of semiconductor devices 121 is embedded within the second housing 105 and is partially disposed within the second plurality of chambers 117. The second plurality of semiconductor devices 121 includes a second plurality of antennas (not shown) disposed in the semiconductor devices 121 in such a way that at least a portion of each of the antennas is located within the second plurality of chambers 117.

Thus each chamber 117 contains at least one antenna that is configured and aligned within the chamber 117 for the receipt of the signal beam generated by one of the antennas located within one of the chambers 107 of the first housing 103. A plurality of cables 129 provide electrical connections between the semiconductor devices 121 in the second housing 105 and a circuit board (not shown) or other device.

When the first housing 103 is mated with the second housing 105, as best seen in FIG. 1B, the antennas embedded within the first housing 103 are in a spaced-apart relationship with the antennas that are embedded within the second housing 105. The first housing 103 has a latch 125 that is adapted to engage a stop 123 on the second housing 105, thereby removably attaching the first housing 103 to the second housing 105. In other embodiments, however, other couplers may be used as well. When the housings are attached, the first and second pluralities of chambers 107, 117 are aligned with one another thereby in effect forming a plurality of unified, metallized chambers or shells which act as waveguides for millimeter wave frequency signals (such as, for example, 60 GHz band signals) that can travel between the antenna pairs. Thus the plurality of antennas in the first housing 103 is adapted to communicate with the plurality of antennas in the second housing 105 via wireless signals that travel in a plurality of paths that are substantially parallel, thus providing ultra-high bandwidth data transmission capabilities.

It can be appreciated that the connector assembly 101 provides isolation between adjacent signals operating at the same frequency. Each chamber within each of the housings provides mechanical alignment and support for its installed antenna relative to the housing in which it is installed. Also, the mated housings provide mechanical alignment and spacing for the antennas relative to one another.

In other embodiments, housing couplers, such as latches, are not used. Rather an assembly is provided wherein the first and second pluralities of chambers 107, 117 are aligned with one another for a relatively brief amount of time, during which data transfer can occur. Thus for example two sets of chambers may be manually aligned and held together (rather than latched together) in a relatively transitory time frame for data transfer.

In the embodiment of FIGS. 1A and 1B, the pluralities of chambers 107, 117 are arranged in a one-dimensional array of five pairs of chambers. Alternative embodiments however can employ a greater or lesser number of chamber pairs, including the use of just one pair of antennas.

Figure 2A:
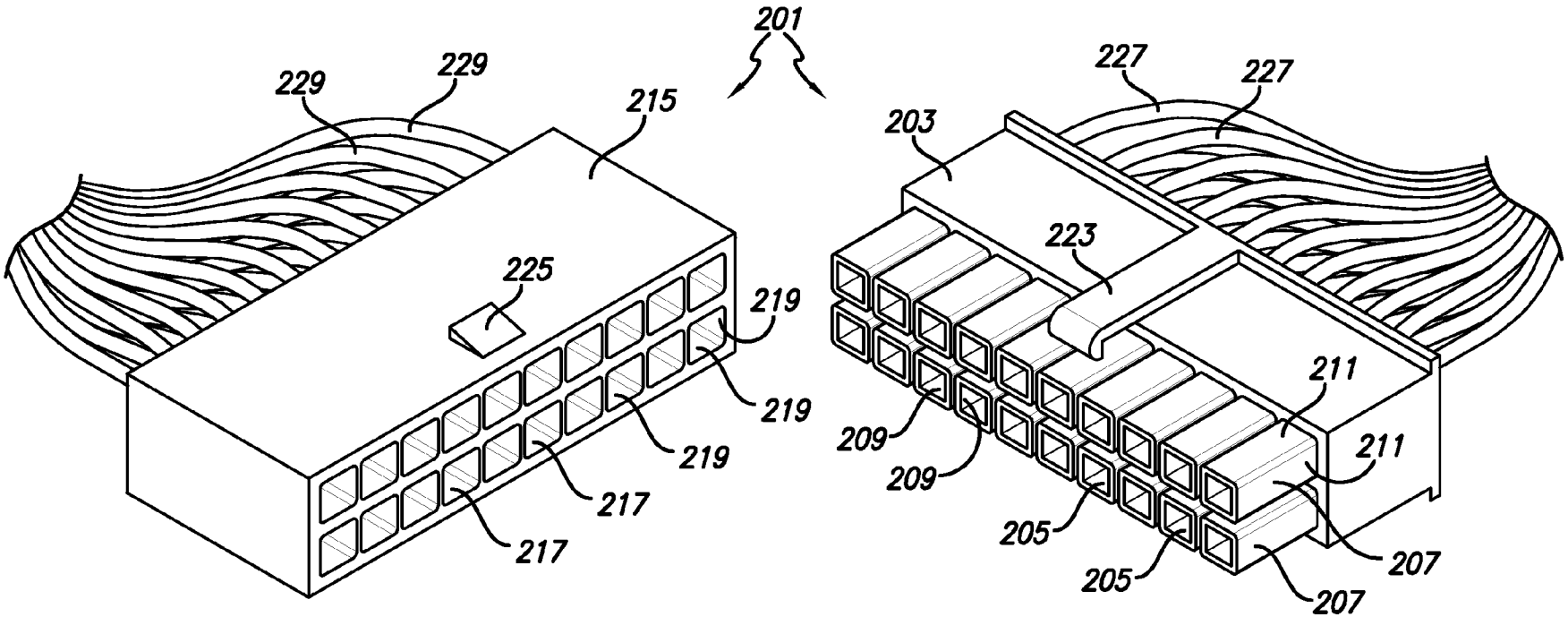
FIG. 2A is a perspective view of a connector assembly in accordance with another embodiment of the invention.
Figure 2B:
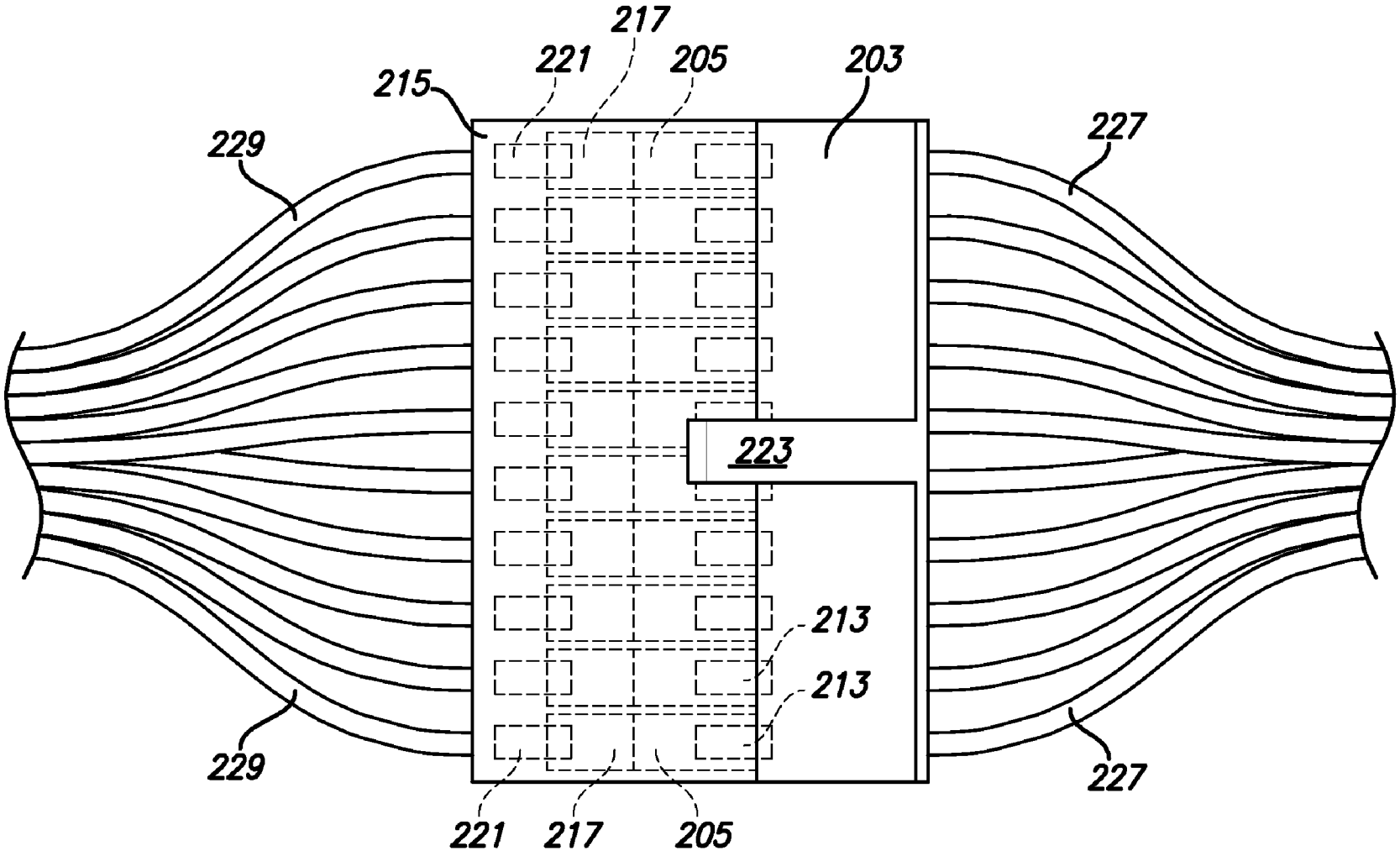
FIG. 2B is a top plan view of the connector assembly of FIG. 2A wherein the two housings are mated.

Still another embodiment of the invention is shown in FIGS. 2A and 2B, wherein a connector assembly 201 uses a two-dimensional array of chambers for wireless millimeter wave communications. This connector assembly 201 is generally the same as that of FIGS. 1A and 1B, except that this two-dimensional array of chambers and antennas is used.

A first housing 203 is comprised of a first plurality of chambers 205 defined by a plurality of projections 207 disposed in a two-dimensional array. Each chamber 205 has a plurality of outer walls 211 and a plurality of inner walls 209 that are constructed of a conductive material, such as aluminum, that is connected to ground. A plurality of semiconductor devices 213 is embedded within the first housing 203 and is partially disposed within the first plurality of chambers 205.

The plurality of semiconductor devices 213 includes a plurality of antennas (not shown) disposed in the semiconductor devices 213 in such a way that at least a portion of each of the antennas is located within the first plurality of chambers 205. Each of the antennas is adapted for communication at a frequency in the millimeter wave spectrum of frequencies, such as, for example, the 60 GHz band. A plurality of cables 227 potentially having one or more signaling conductors provide electrical connections between the semiconductor devices 213 in the first housing 203 and a circuit board (not shown) or other device.

A second housing 215 is comprised of a second plurality of chambers 217 disposed in a two-dimensional array. Each chamber 217 is defined by a plurality of interior walls 219 and is adapted to receive one of the plurality of projections 207 of the first housing 203, as best seen in FIG. 2B. Each interior wall 219 is constructed of a conductive material, such as aluminum, that is electrically connected to ground. A second plurality of semiconductor devices 221 is embedded within the second housing 215 and is partially disposed within the second plurality of chambers 217.

The second plurality of semiconductor devices 221 includes a second plurality of antennas (not shown) disposed in the semiconductor devices 221 in such a way that at least a portion of each of the antennas is located within the second plurality of chambers. Each of the second plurality of antennas is adapted for communication at the same frequency as the first plurality of antennas. A plurality of cables 229 provides electrical connections between the semiconductor devices 221 in the second housing 215 and a circuit board (not shown) or other device.

When the first housing 203 is mated with the second housing 215, as best seen in FIG. 2B, the antennas embedded within the first housing 203 are in a spaced-apart relationship with the antennas that are embedded within the second housing 215. The first housing 203 has a latch 223 that is adapted to engage a stop 225 on the second housing 215, thereby removably attaching the first housing 203 to the second housing 215. In other embodiments, however, other couplers may be used as well.

When the housings are attached, the first and second pluralities of chambers 205, 217 are aligned with one another thereby in effect forming a plurality of unified, metallized chambers or shells which act as waveguides for a plurality of millimeter wave frequency signals (such as, for example, the 60 GHz band signals) that can travel between the antenna pairs. Thus the plurality of antennas in the first housing 203 is adapted to communicate with the plurality of antennas in the second housing 215 via wireless signals that travel in a plurality of paths that are substantially parallel. While FIGS. 2A and 2B show 2×10 arrays of chambers, alternative embodiments include arrays having a greater or fewer number of rows and a greater or fewer number of columns.

In the above-described embodiments, the antennas are embedded within a plurality of semiconductor devices which in turn are embedded in first and second housings. Alternative embodiments of the invention include a single semiconductor device at least partially disposed in each housing, wherein each semiconductor device has a plurality of antennas disposed in the device. The single semiconductor device in each housing is shaped such that the plurality of antennas extends into the plurality of chambers of each housing.

In yet another embodiment, semiconductor devices are not disposed in the chambers of the housings. Rather, the antennas (or at least a portion of the antennas) are disposed in the chambers but are not fully embedded in semiconductor devices. These antennas are comprised of a conductor that is not integral with any semiconductor device, but is electrically connected to radio and signal processing circuitry located elsewhere in each housing or alternatively, located elsewhere on a circuit board or other device which is connected to the housing via a plurality of cables.

In the above-described embodiments, the plurality of antennas in the first housing transmits signals that are received by the plurality of antennas in the second housing. Alternative embodiments include other combinations, such as for example, the antennas in the second housing transmitting to the antennas in the first housing, or alternatively, a portion of the antennas in the first housing transmitting to a portion of the antennas in the second housing while another portion of the antennas in the first housing receiving signals from another portion of antennas in the second housing, or alternatively still, the antennas of both housings serving as transceiver antennas. In the case of transceiver antennas, embodiments include transceivers that can both transmit and receive, but only perform one function at a time. However, other embodiments include transceivers that can both transmit and receive simultaneously. In this case, these components operate at a dual frequency, such as for example one frequency at 60 GHz and the other at 61 GHz, thus enabling the simultaneous transmission and reception of signals.

In operation, according to one embodiment of the invention, a first housing is positioned adjacent to a second housing by removably attaching the first and second housings to one another. The first housing is comprised of a first plurality of chambers that is at least partially defined by a plurality of projections. The second housing is comprised of a second plurality of chambers adapted to receive the plurality of projections. The first and second pluralities of chambers are disposed in one-dimensional arrays, or alternatively, in two-dimensional arrays. Thus positioning the first and second housings adjacent to one another includes at least partially inserting the plurality of projections into the second plurality of chambers. At least a portion of each chamber of the first and second pluralities of chambers is constructed of a conductive material. When the first housing is positioned adjacent to the second housing, the first plurality of chambers is aligned with the second plurality of chambers.

A plurality of wireless signals is transmitted in a plurality of paths that are substantially parallel and at a frequency in the millimeter wave spectrum of frequencies, by using a first plurality of antennas disposed in the first plurality of chambers. The wireless signals are received using a second plurality of antennas disposed in the second plurality of chambers.

Figure 3:
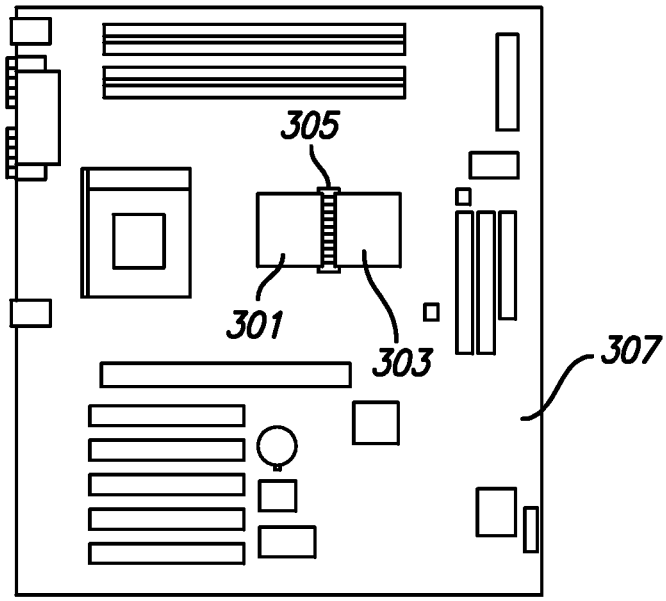
FIG. 3 is a simplified drawing of a connector assembly directly attached to a printed circuit board.

In the embodiments of FIGS. 1A, 1B, 2A, and 2B, the connector assemblies (including their antennas) stand alone, but are electrically connected to circuit boards or other devices via a plurality of cables. FIG. 3 shows an alternative embodiment wherein a connector assembly 305 includes a first housing 301 and a second housing 303 that are mechanically and electrically connected directly to a printed circuit board 307, with the first housing 301 positioned adjacent to the second housing 303. The structure of the housings 301, 303 is generally similar to that of FIGS. 1A and 1B, or 2A and 2B, except that cables do not extend from the rear of the housings. Rather, the electrical connections between the antennas and semiconductor devices within the housings 301, 303 are made directly to the circuit board 307 via pins or other circuit board electrical connectors.

In an alternative embodiment, the two connected housings 301, 303 on the circuit board of FIG. 3 are replaced with two semiconductor devices. That is, rather than using housings that are constructed of plastic or other suitable material and that include metallized chambers and antennas, two semiconductor devices are employed. Each semiconductor device defines a plurality of chambers, arrayed in one or two dimensions. Each chamber has a wall constructed of a conductive material and surrounds at least one antenna adapted for communication at a frequency in the millimeter wave spectrum of frequencies. Each semiconductor device is adapted for direct electrical and mechanical connection to the circuit board via pins or other connectors so that the two devices are adjacent to one another thereby aligning their respective chambers and antenna pairs.

Figure 4:
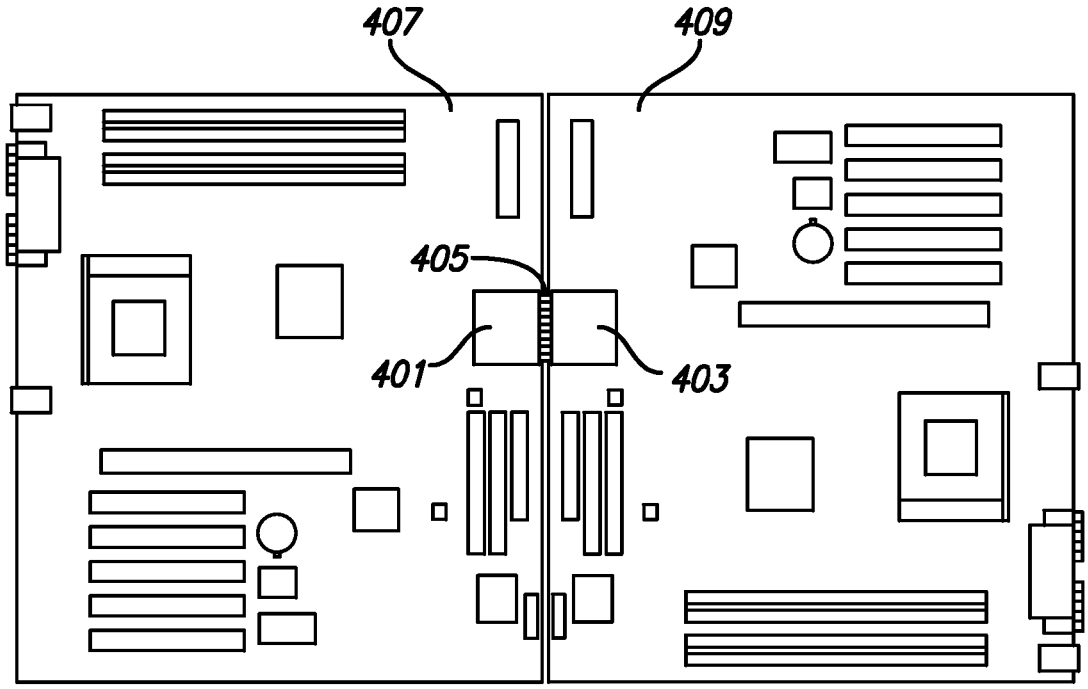
FIG. 4 is a simplified drawing of connector assembly components directly attached to two printed circuit boards.

FIG. 4 shows an alternative embodiment of the invention wherein a connector assembly 405 includes a first housing 401 and a second housing 403 that are mechanically and electrically connected directly to two printed circuit boards 407, 409, respectively. The first housing 401 is positioned adjacent to the second housing 403 when the two circuit boards 407, 409 are secured or otherwise adjacent to one another. The structure of the housings 401, 403 is generally similar to that of FIGS. 1A and 1B, or 2A and 2B, except that cables do not extend from the rear of the housings. Rather, the electrical connections between the antennas and semiconductor devices within the housings are made directly to their respective circuit boards via pins or other circuit board electrical connectors.

In an alternative embodiment, the two connected housings 401, 403 on the two circuit boards 407, 409 of FIG. 4 are replaced with two semiconductor devices. That is, rather than using housings that are constructed of plastic or other suitable material and that include metallized chambers and antennas, two semiconductor devices are employed. Each semiconductor device defines a plurality of chambers, arrayed in one or two dimensions. Each chamber has a wall constructed of a conductive material and surrounds at least one antenna adapted for communication at a frequency in the millimeter wave spectrum of frequencies. Each semiconductor device is adapted for direct electrical and mechanical connection to its respective circuit board via pins or other connectors so that the two devices are adjacent to one another thereby aligning their respective chambers and antenna pairs when the two circuit boards are adjacent to one another.

According to another embodiment of the invention, a housing having a plurality of projections (such as for example the first housing 103 of FIG. 1) move like fingers through a matching set of slots with a matching plurality of antennas disposed in the bottom of the slots. Guides at the entrance to the slots assist in dynamic alignment. This embodiment allows the projections to move in unison along a path defined by the slots and make contactless connection with antennas at one or more stops along the way. The applications for this embodiment are many. For example, assembly lines can use this to exchange high speed data between a sled being indexed and factory electronics as the sled moves from station to station. Another application would permit a car (with fingers or projections) to drive over a floor device (with slots) and exchange high speed data in a garage or a work environment.

Figure 5A:
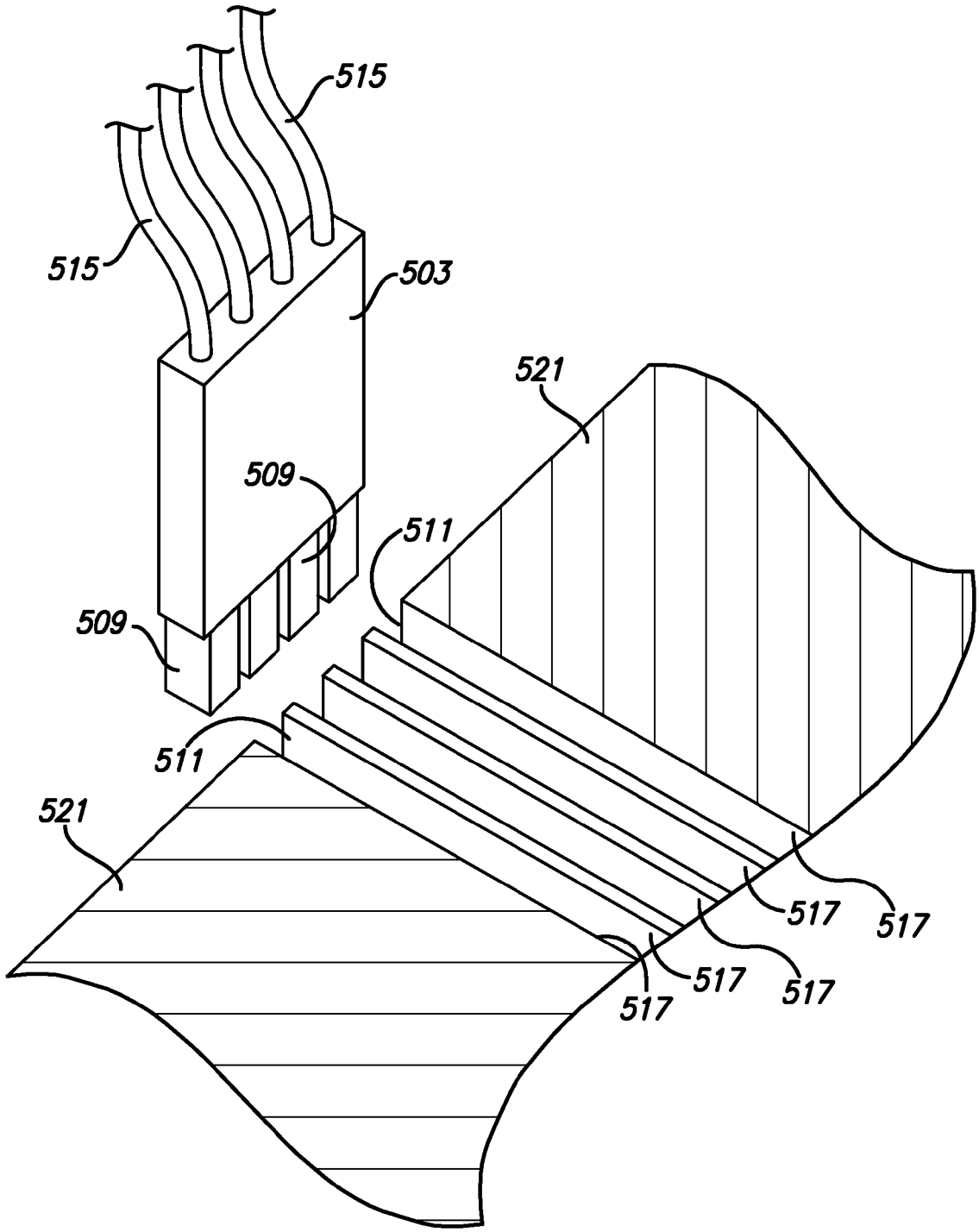
FIG. 5A is a perspective view of an antenna assembly in accordance with another embodiment of the invention.
Figure 5B:
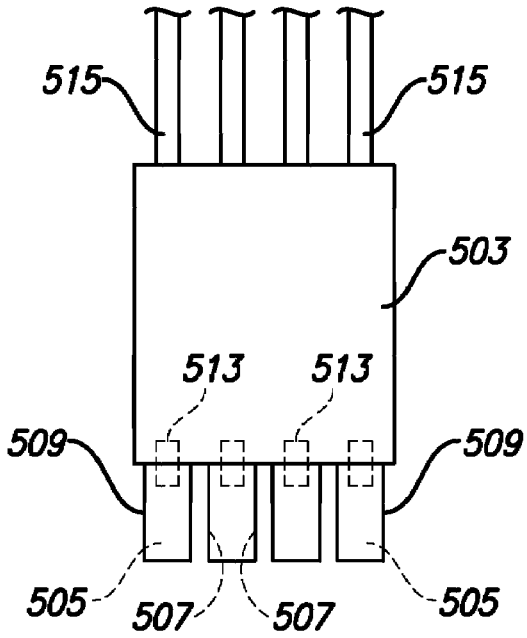
FIG. 5B is a front plan view of the housing and chamber portion of the antenna assembly of FIG. 5A.
Figure 5C:
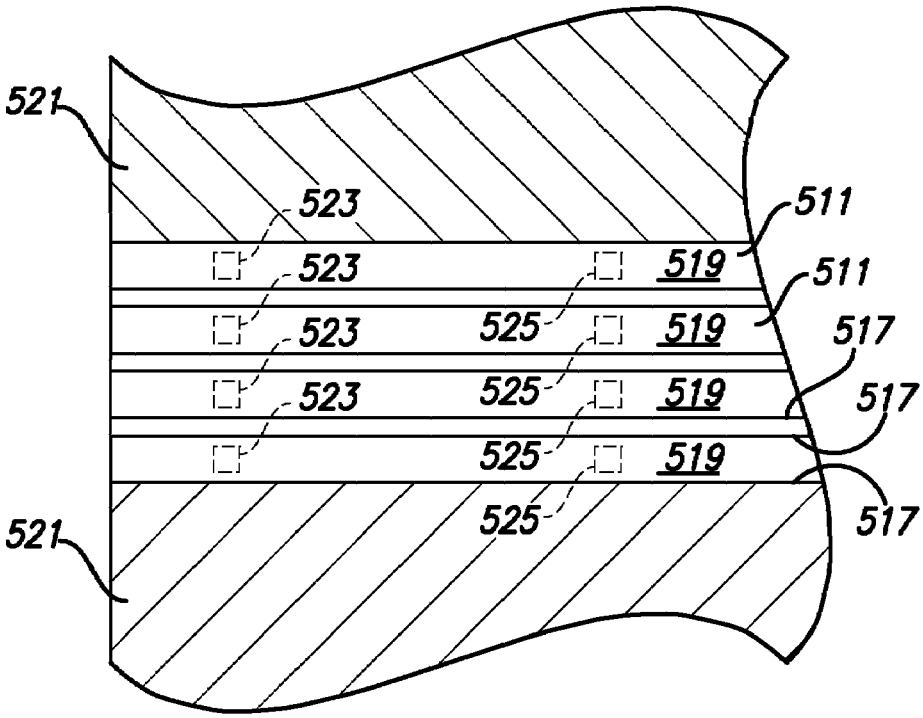
FIG. 5C is a top plan view of the slots portion of the antenna assembly of FIG. 5A.

FIGS. 5A, 5B and 5C illustrate an example of such an embodiment employing a housing assembly and slot arrangement for use in wireless millimeter wave communications. Shown is a housing 503 comprised of a plurality of chambers 505 defined by a plurality of walls 507 forming a plurality of projections 509. The housing 503 is essentially the same as the first housing 103 of FIGS. 1A and 1B, except that the projections 509 of the housing 503 of FIG. 5A are spaced apart sufficiently so that they may mate in a sliding engagement with a plurality of slots 511. Although not shown, the housing 503 is attached to a factory sled or other machine or device that is or can be in motion.

A plurality of semiconductors devices 513 is embedded within the housing 503 and is partially disposed within the plurality of chambers 505. The plurality of semiconductors devices 513 includes a first plurality of antennas (not shown) disposed in the semiconductor devices 513 in such a way that at least a portion of each of the antennas is located within the plurality of chambers 505. Thus each chamber 505 contains at least one antenna that is configured and aligned within the chamber 505 for the transmission of a relatively narrow beam directed down the length of the chamber 505. Each of the antennas is adapted for communication at a frequency in the millimeter wave spectrum of frequencies, such as for example, the 60 GHz band. A plurality of cables 515 provides electrical connections between the semiconductor devices 513 in the housing 503 and a circuit board (not shown) or other device.

The plurality of projections 509 of the housing 503 are adapted to slidably mate with the plurality of slots 511 defined by a plurality of side walls 517 and bottom walls 519. The slots 511 extend below a working surface 521, such as for example, a factory floor, a work bench, a conveyor surface, a garage floor, or any other surface. A second plurality of semiconductor devices 523 is disposed on or embedded in the bottom walls 519 of the plurality of slots 511. The second plurality of semiconductor devices 523 includes a second plurality of antennas (not shown) that are disposed in the semiconductor devices 523, and that are adapted for communication at the same frequency as the first plurality of antennas located in the housing 503. The projections 509 of the housing 503 can slide along the channels formed by the slots 511. When the housing 503 is stopped at a first position relative to the slots 511, the projections 509 of the housing 503 are disposed above and adjacent to the second plurality of antennas located on or embedded in the bottom walls 509 of the slots 511. At this point, the first plurality of antennas is aligned with the second pluralities of antennas, so that the antenna pairs are enclosed by the metallized chambers 505 which act as waveguides for millimeter wave frequency signals that can travel between the antenna pairs. In alternative embodiments, however, the side walls 517 of the slots 511 are metallized thereby forming all or a portion of the metallized waveguides.

A third plurality of semiconductor devices 525 is disposed on or in the bottom walls 519 within the plurality of slots 511. Similarly, the third plurality of semiconductor devices 525 includes a third plurality of antennas (not shown) that are disposed in the semiconductor devices 525 and that are adapted for communication at the same frequency. When the housing 503 is stopped at a second position relative to the slots 511, the projections 509 of the housing 503 are disposed above and adjacent to the third plurality of antennas located on or embedded in the bottom walls 519 of the slots 511.

While the illustrated embodiment of FIGS. 5A, 5B and 5C shows two sets of semiconductor devices having two sets of antennas located at two housing stopping positions relative to the slots 511, it will be appreciated that a greater or fewer number of sets of antennas and a greater or fewer number of housing stopping positions may be employed without departing from the spirit and scope of the invention. Moreover, while the illustrated embodiment shows slots that define a generally straight pathway, other embodiments may use pathways that are curved.

Thus disclosed are methods and apparatuses for achieving ultra-high bandwidth data transmission. According to certain embodiments of the invention, a plurality of parallel 60 GHz band frequency signals (or other millimeter wave signals) traveling in substantially parallel paths are employed. A pair of housings includes metallized, grounded shells or chambers having antenna pairs that are embedded therein. In exterior appearance, the housings are similar to that used for traditional, electrical power connectors for computer components. (Alternatively, semiconductor devices defining metallized chambers are used in lieu of housings.) However there is no physical contact between the transmitter and receiver antennas. Instead the metallized, grounded connector chambers or shells provide isolation between adjacent radio links which can all operate on the same frequency.

While the description above refers to particular embodiments of the present invention, it will be understood that many modifications may be made without departing from the spirit thereof. The claims are intended to cover such modifications as would fall within the true scope and spirit of the present invention. The presently disclosed embodiments are therefore to be considered in all respects as illustrative and not restrictive, the scope of the invention being indicated by the claims rather than the foregoing description, and all changes which come within the meaning and range of equivalency of the claims are therefore intended to be embraced therein.

What is claimed is:

1. An apparatus comprising:

a first housing comprising a first plurality of walls defining a first plurality of chambers;

a first plurality of antennas disposed within the first plurality of chambers and adapted for communication at a frequency in the millimeter wave spectrum of frequencies;

a second housing comprising a second plurality of walls defining a second plurality of chambers; and a second plurality of antennas disposed within the second plurality of chambers and adapted for communication at the frequency;

wherein at least a portion of at least one wall that defines each chamber of one of the first plurality of chambers and the second plurality of chambers is constructed of a conductive material, and wherein the first plurality of chambers is aligned with the second plurality of chambers when the first housing is adjacent to the second housing.

2. The apparatus of claim 1 further comprising a coupler for removably attaching the first housing to the second housing.

3. The apparatus of claim 1 further comprising a latch connected to the first housing, wherein the latch is adapted to engage the second housing thereby removably attaching the first housing to the second housing.

4. The apparatus of claim 1 wherein the first housing comprises a plurality of projections defining the first plurality of chambers, and wherein the second plurality of chambers is adapted to receive the plurality of projections thereby aligning the first and second pluralities of chambers.

5. The apparatus of claim 1 wherein each of the first plurality of antennas is further adapted to transmit signals and each of the second plurality of antennas is further adapted to receive signals.

6. The apparatus of claim 1 wherein the frequency is in the 60 GHz band.

7. The apparatus of claim 1 wherein the first and second pluralities of antennas are adapted for communication via a plurality of signals that travel in a plurality of paths that are substantially parallel.

8. The apparatus of claim 1 wherein the first plurality of chambers is disposed in a one-dimensional array, and the second plurality of chambers is disposed in a one-dimensional array.

9. The apparatus of claim 1 wherein the first plurality of chambers is disposed in a two-dimensional array, and the second plurality of chambers is disposed in a two-dimensional array.

10. The apparatus of claim 1 further comprising:

a first plurality of semiconductor devices at least partially disposed within the first plurality of chambers, wherein the first plurality of semiconductor devices includes the first plurality of antennas disposed in the first plurality of semiconductor devices; and a second plurality of semiconductor devices at least partially disposed within the second plurality of chambers, wherein the second plurality of semiconductor devices includes the second plurality of antennas disposed in the second plurality of semiconductor devices.

11. The apparatus of claim 1 further comprising:

a first semiconductor device at least partially disposed within the first housing, wherein the first semiconductor device includes the first plurality of antennas disposed in the first semiconductor device; and a second semiconductor device at least partially disposed within the second housing, wherein the second semiconductor device includes the second plurality of antennas disposed in the second semiconductor device.

12. The apparatus of claim 1 further comprising a printed circuit board, wherein the first and second housings are mechanically and electrically connected to the printed circuit board with the first housing positioned adjacent to the second housing.

13. The apparatus of claim 1 further comprising a first printed circuit board and a second printed circuit board, wherein the first housing is mechanically and electrically connected to the first printed circuit board, wherein the second housing is mechanically and electrically connected to the second printed circuit board, and wherein the first and second printed circuit boards are adapted for placement adjacent to one another thereby positioning the first housing adjacent to the second housing.

14. An apparatus comprising:

a first housing comprising a first plurality of walls defining a first plurality of chambers;

a first plurality of antennas disposed within the first plurality of chambers and adapted for communication at a frequency in the millimeter wave spectrum of frequencies;

a second housing comprising a second plurality of walls defining a second plurality of chambers; and a second plurality of antennas disposed within the second plurality of chambers and adapted for communication at the frequency;

wherein at least a portion of at least one wall of the first plurality of walls that defines each chamber of the first plurality of chambers is constructed of a conductive material, wherein at least a portion of at least one wall of the second plurality of walls that defines each chamber of the second plurality of chambers is constructed of a conductive material, and wherein the first plurality of chambers is aligned with the second plurality of chambers when the first housing is adjacent to the second housing.

15. The apparatus of claim 14 wherein the first and second pluralities of antennas are adapted for communication via a plurality of signals that travel in a plurality of paths that are substantially parallel.

16. An apparatus comprising:

a circuit board;

a first semiconductor device mounted on the circuit board, the first semiconductor device having a first plurality of walls defining a first plurality of chambers, wherein at least a portion of each wall of the first plurality of walls is constructed of a conductive material, and wherein the first semiconductor device has a first plurality of antennas disposed within the first plurality of chambers and adapted for communication at a frequency in the millimeter wave spectrum of frequencies; and a second semiconductor device mounted on the circuit board adjacent to the first semiconductor device, the second semiconductor device having a second plurality of walls defining a second plurality of chambers, wherein at least a portion of each wall of the second plurality of walls is constructed of a conductive material, wherein the second semiconductor device has a second plurality of antennas disposed within the second plurality of chambers and adapted for communication at the frequency, wherein the first plurality of chambers is aligned with the second plurality of chambers when the first semiconductor device is adjacent to the second semiconductor device, and wherein the first and second pluralities of antennas are adapted for communication via a plurality of signals that travel in a plurality of paths that are substantially parallel when the first semiconductor device is adjacent to the second semiconductor device.

17. The apparatus of claim 16 wherein the first and second pluralities of chambers are disposed in a two-dimensional array.

18. An apparatus comprising:

a first circuit board and a second circuit board;

a first semiconductor device mounted on the first circuit board, the first semiconductor device having a first plurality of walls defining a first plurality of chambers, wherein at least a portion of each wall of the first plurality of walls is constructed of a conductive material, and wherein the first semiconductor device has a first plurality of antennas disposed within the first plurality of chambers and adapted for communication at a frequency in the millimeter wave spectrum of frequencies; and a second semiconductor device mounted on the second circuit board, the second semiconductor device having a second plurality of walls defining a second plurality of chambers, wherein at least a portion of each wall of the second plurality of walls is constructed of a conductive material, wherein the second semiconductor device has a second plurality of antennas disposed within the second plurality of chambers and adapted for communication at the frequency, wherein the first and second semiconductor devices are mounted respectively on the first and second circuit boards so that the first and second semiconductor devices are adjacent to one another when the first and second circuit boards are adjacent to one another, wherein the first plurality of chambers is aligned with the second plurality of chambers when the first semiconductor device is adjacent to the second semiconductor device, and wherein the first and second pluralities of antennas are adapted for communication via a plurality of signals that travel in a plurality of paths that are substantially parallel when the first semiconductor device is adjacent to the second semiconductor device.

19. The apparatus of claim 18 wherein the first and second pluralities of chambers are disposed in a two-dimensional array.

20. An apparatus comprising:

a housing comprising a plurality of projections having a first plurality of walls defining a first plurality of chambers;

a first plurality of antennas disposed within the first plurality of chambers and adapted for communication at a frequency in the millimeter wave spectrum of frequencies;

a second plurality of walls defining a plurality of slots adapted to permit slidable positioning of the plurality of projections within the plurality of slots; and a second plurality of antennas disposed within the plurality of slots and adapted for communication at the frequency, wherein at least a portion of at least one of the first plurality of walls and the second plurality of walls is constructed of a conductive material, and wherein the first plurality of chambers is aligned with the second plurality of antennas when the housing is disposed at a first position relative to the plurality of slots such that the first plurality of projections is disposed in the plurality of slots and adjacent to the second plurality of antennas.

21. The apparatus of claim 20 wherein the first and second pluralities of antennas are adapted for communication via a plurality of signals that travel in a plurality of paths that are substantially parallel.

22. The apparatus of claim 20 further comprising a third plurality of antennas disposed within the plurality of slots at a second plurality of locations and adapted for communication at the frequency, wherein the first plurality of chambers is aligned with the third plurality of antennas when the housing is disposed at a second position relative to the plurality of slots such that the first plurality of projections is disposed in the plurality of slots and adjacent to the third plurality of antennas.

23. The apparatus of claim 22 wherein the first and third pluralities of antennas are adapted for communication via a plurality of signals that travel in a plurality of paths that are substantially parallel.

24. A method of communication comprising:

positioning a first housing adjacent to a second housing, wherein the first housing has a first plurality of walls defining a first plurality of chambers, wherein the second housing has a second plurality of walls defining a second plurality of chambers, wherein at least a portion of at least one wall that defines each chamber of one of the first plurality of chambers and the second plurality of chambers is constructed of a conductive material, and wherein the first plurality of chambers is aligned with the second plurality of chambers when the first housing is adjacent to the second housing;

transmitting a plurality of wireless signals at a frequency in the millimeter wave spectrum of frequencies using a first plurality of antennas disposed in the first plurality of chambers; and receiving the plurality of wireless signals using a second plurality of antennas disposed in the second plurality of chambers.

25. The method of claim 24 wherein positioning the first housing adjacent to the second housing includes removably attaching the first housing to the second housing.

26. The method of claim 24 wherein the first housing comprises a plurality of projections defining the first plurality of chambers, wherein the second plurality of chambers is adapted to receive the plurality of projections, and wherein positioning the first housing adjacent to the second housing includes at least partially inserting the first plurality of projections into the second plurality of chambers.

27. The method of claim 24 wherein the frequency is in the 60 GHz band.

28. The method of claim 24 wherein transmitting the plurality of wireless signals includes transmitting the plurality of wireless signals in a plurality of paths that are substantially parallel.

29. The method of claim 24 wherein the first and second pluralities of chambers are disposed in a two-dimensional array.

30. An apparatus comprising:

a first plurality of chambers;

a second plurality of chambers;

means for transmitting a plurality of wireless signals at a frequency in the millimeter wave spectrum of frequencies; and means for receiving the plurality of wireless signals.

31. The apparatus of claim 30 further comprising a first housing defining the first plurality of chambers, a second housing defining the second plurality of chambers, and means for removably attaching the first housing to the second housing.

32. The apparatus of claim 30 wherein the frequency is in the 60 GHz band.

33. The apparatus of claim 30 wherein the first and second pluralities of chambers are disposed in a two-dimensional array.

* * * * *

UNITED STATES PATENT AND TRADEMARK OFFICE

CERTIFICATE OF CORRECTION

PATENT NO. : 7,598,923 B2
APPLICATION NO. : 11/419609
DATED : October 6, 2009
INVENTOR(S) : Hardacker et al.

It is certified that error appears in the above-identified patent and that said Letters Patent is hereby corrected as shown below:

On the cover page,

[*] Notice: Subject to any disclaimer, the term of this patent is extended or adjusted under 35 USC 154(b) by 517 days Delete the phrase "by 517 days" and insert -- by 654 days --

Signed and Sealed this

Eleventh Day of May, 2010

David J. Kappos

David J. Kappos
*Director of the United States Patent and Trademark Office*